US008839855B1

(12) United States Patent
McClinton et al.

(10) Patent No.: US 8,839,855 B1
(45) Date of Patent: Sep. 23, 2014

(54) MODULAR CHANGEABLE FRACTIONATION PLUG

(75) Inventors: Tony D. McClinton, Odessa, TX (US); Stanley Keeling, Odessa, TX (US)

(73) Assignee: McClinton Energy Group, LLC, Odessa, TX (US)

( * ) Notice: Subject to any disclaimer, the term of this patent is extended or adjusted under 35 U.S.C. 154(b) by 394 days.

(21) Appl. No.: 13/402,834

(22) Filed: Feb. 22, 2012

(51) Int. Cl.
*E21B 33/129* (2006.01)
*E21B 33/134* (2006.01)

(52) U.S. Cl.
USPC ..... 166/135; 166/193; 166/179

(58) Field of Classification Search
USPC ..... 166/179, 118, 135, 196, 192, 133, 193, 166/124
See application file for complete search history.

(56) References Cited

U.S. PATENT DOCUMENTS

| | | | | | |
|---|---|---|---|---|---|
| 2,204,648 | A * | 6/1940 | Baker | | 166/134 |
| 4,437,516 | A * | 3/1984 | Cockrell | | 166/120 |
| 4,595,052 | A * | 6/1986 | Kristiansen | | 166/123 |
| 5,224,540 | A * | 7/1993 | Streich et al. | | 166/118 |
| 6,220,349 | B1 | 4/2001 | Vargus et al. | | |
| 6,491,108 | B1 | 12/2002 | Slup et al. | | |
| 6,581,681 | B1 | 6/2003 | Zimmerman et al. | | |
| 6,796,376 | B2 | 9/2004 | Frazier | | |
| 7,350,582 | B2 * | 4/2008 | McKeachnie et al. | | 166/373 |
| 7,740,079 | B2 * | 6/2010 | Clayton et al. | | 166/387 |
| 7,789,137 | B2 * | 9/2010 | Turley et al. | | 166/138 |
| 8,079,413 | B2 * | 12/2011 | Frazier | | 166/124 |
| D657,807 | S * | 4/2012 | Frazier | | D15/139 |
| D673,183 | S * | 12/2012 | Frazier | | D15/21 |
| 8,336,616 | B1 * | 12/2012 | McClinton | | 166/135 |
| 8,443,898 | B1 * | 5/2013 | McClinton et al. | | 166/363 |
| 8,448,701 | B1 * | 5/2013 | McClinton et al. | | 166/86.1 |
| 8,459,346 | B2 * | 6/2013 | Frazier | | 166/124 |
| 8,490,689 | B1 * | 7/2013 | McClinton et al. | | 166/135 |
| 8,590,616 | B1 * | 11/2013 | McClinton et al. | | 166/135 |
| 2007/0151722 | A1 * | 7/2007 | Lehr et al. | | 166/123 |
| 2007/0187085 | A1 * | 8/2007 | Dewey et al. | | 166/55 |
| 2008/0060821 | A1 * | 3/2008 | Smith et al. | | 166/387 |
| 2010/0132960 | A1 * | 6/2010 | Shkurti et al. | | 166/387 |
| 2010/0155050 | A1 * | 6/2010 | Frazier | | 166/102 |
| 2011/0036564 | A1 * | 2/2011 | Williamson | | 166/188 |
| 2011/0240295 | A1 * | 10/2011 | Porter et al. | | 166/308.1 |

* cited by examiner

*Primary Examiner* — Daniel P Stephenson
(74) *Attorney, Agent, or Firm* — K&L Gates LLP

(57) ABSTRACT

A modular changeable fractionation plug for use in a wellbore with a crown engagement and a plug receiving end formed on a mandrel which is adapted to be a caged ball configuration, a drop ball configuration and a bridge plug configuration.

15 Claims, 12 Drawing Sheets

MODULAR CHANGEABLE FRACTIONATION PLUG

FIELD

The present embodiments generally relate to a fractionation plug which is highly versatile and can provide in one mandrel, a caged ball fractionation plug, a bridge type fractionation plug, and a ball drop fractionation plug for segregating fractionation zones in a wellbore.

BACKGROUND

A need exists for a fractionation plug which can avoid becoming stuck in the wellbore during completion operations in deviated wellbores, horizontal wellbores, and vertical wellbores.

A further need exists for a fractionation plug that can quickly and securely engage with the crown engagement of another fractionation plug, which can prevent fractionation plugs from spinning during drill-out.

A further need exists for equipment that can be utilized for more than one pump down procedure, a caged ball, a ball drop, and a bridge type plug which can allow for decreased transportation costs and more procedures to be served by the same equipment.

A further need exists for equipment that can allow engineers to select between different procedures by changing components in the same equipment without leaving the job site.

The present embodiments meet these needs.

BRIEF DESCRIPTION OF THE DRAWINGS

The detailed description will be better understood in conjunction with the accompanying drawings as follows.

Figure 1A:
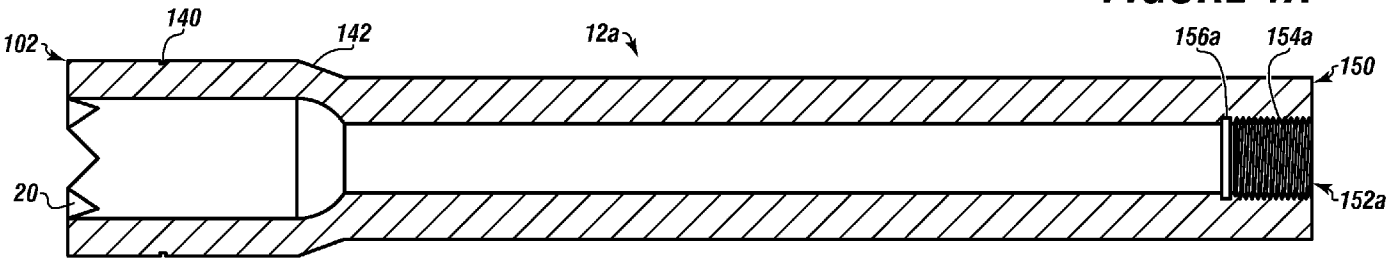
FIG. 1A depicts a mandrel according to one or more embodiments.

The present embodiments are detailed below with reference to the listed figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a modular changeable fractionation plug for use in separating an upper zone from a lower zone in a wellbore.

The modular changeable fractionation plug can be used to separate an upper zone from a lower zone in a wellbore. The modular changeable fractionation plug can have a ball drop configuration, a bridge plug configuration, and a caged ball configuration using one mandrel.

The modular changeable fractionation plug can have a versatile adaptable mandrel with a central annulus and a crown engagement, and one or more plug receiving portions.

The crown engagement can have a diameter larger than the plug receiving portions.

A mandrel shoulder can be formed between the crown engagement and the second end.

A load ring can be connected with the mandrel. The load ring can slide onto or otherwise be disposed about the mandrel.

A first slip can be disposed adjacent to the load ring. A first slip backup can be adjacent the first slip on the mandrel.

A first lubricating spacer can be adjacent the first slip backup.

A first secondary seal can be adjacent the first lubricating spacer.

A primary seal can be positioned next to the first secondary seal.

A second secondary seal can be adjacent the primary seal. In an embodiment, the primary seal can be a 3 segment seal or a 1 segment seal.

A second lubricating spacer can be a second lubricating spacer can be adjacent the primary seal.

A second slip backup can be adjacent the second lubricating spacer.

A second slip can be adjacent the second slip backup.

A removable nose cone with two faces that taper toward a point can be disposed over the mandrel adjacent the second slip backup.

The removable nose cone can have in an integral one piece constructions, a nose cone body which can have an opening (an annulus); a tapered engagement which can be integral with the nose cone body, wherein the tapered engagement comprises a first sloped face, and a second sloped face; a pump down ring groove formed between the nose cone body and the tapered engagement for containing a pump down ring; a plurality of pressure relief grooves extending longitudinally, with each pressure relief groove disposed on an outer surface of the tapered engagement; and a facial seal formed in the plug receiving end of the mandrel.

The mandrel can be adapted to use a bridge plug. The bridge plug can connect with a first plug receiving portion or second plug receiving portion formed into the mandrel.

The bridge plug can have a bridge plug body engaging the facial seal; a solid end on a first end of the bridge plug body; a load shoulder formed between the bridge plug body and the solid end; an extension extending from the load shoulder opposite the solid end; engaging threads extending over an outer surface of the bridge plug body engaging the internal threads of the plug receiving end.

Additionally, the bridge plug body can have a first chamber, which can have a first diameter; and a second shear device chamber, which can have a second diameter. The second diameter can be larger than the first diameter and form a shear device shoulder.

The bridge plug can have shear threads formed on at least a portion of the second chamber.

The mandrel can be adapted to use a caged ball configuration.

A caged ball plug can be threadable into the first plug receiving portion or the second plug receiving portion.

The caged ball plug can have a caged ball plug body engaging the facial seal, a load shoulder adjacent the caged ball plug body, an extension extending from the load shoulder opposite the facial seal, and engaging threads extending on an outer surface of the caged ball plug body engaging internal threads of the plug receiving end.

Additionally, the caged ball plug body can have an internal caged ball seat formed within the caged ball plug; a caged ball seat guide adjacent the internal caged ball seat; a first chamber adjacent the caged ball seat guide, which can have a first diameter for supporting a caged ball; a caged ball retaining rod adjacent the first chamber; a second chamber formed within the caged ball plug, which can have a second diameter; and shear threads formed on the inner diameter of the second chamber.

The mandrel can also be adapted to use a ball drop plug.

The ball drop plug can be connected to the first plug receiving portion or the second plug receiving portions.

The ball drop plug can have a ball drop body engaging the facial seal; a load shoulder adjacent the ball drop body; an extension extending from the load shoulder; a ball drop plug annulus centrally formed in the ball drop body and extending longitudinally through the body for allowing pressure to flow through the ball drop plug annulus until a fractionation ball seats in a seating area of the crown engagement while simultaneously allowing fluid to flow from a lower fractionation zone to an upper fractionation zone.

The ball drop portion can have engaging threads extending over an outer surface of the ball drop plug body engaging internal threads of the plug receiving end, a first chamber, which can have a first diameter; a second chamber, which can have a second diameter, wherein the second diameter can be larger than the first diameter creating a shear device shoulder for receiving a setting tool; and shear threads formed around the second chamber.

The bridge plug configuration, ball drop configuration, and caged ball configuration with the fractionation plug components, form a modular changeable fractionation plug for use in separating the upper fractionation zone from the lower fractionation zone in a wellbore.

In an embodiment, the bridge plug can have left handed threads.

In an embodiment, the mandrel can be made from 100 percent composite material of epoxy coated glass fibers.

In an embodiment, the slips can be metallic, non-metallic, or combinations thereof.

In an embodiment, the fractionation ball retaining rod can be metallic or non-metallic.

In an embodiment, the fractionation ball retaining rod can extend across the central annulus.

In an embodiment, the fractionation ball retaining rod can have a threaded engagement for engagement with a setting tool.

In an embodiment, the caged ball plug can have left handed threads.

In an embodiment, each slip back-up can contain from about 4 to about 10 longitudinal slots extending partially through the slip backup.

In an embodiment, each slip can comprise radial relief grooves formed in the slips.

In an embodiment, each slip can have a tapered engagement.

In an embodiment, from about 4 to about 10 pressure relief grooves can be formed in each slip. An embodiment can have at least one pressure relief groove disposed on opposite sides of the tapered engagement.

In an embodiment, the first slip and second slip can include teeth segments, which can be disposed along the length of each slip.

In an embodiment, form about 5 to about 20 teeth can be formed on each teeth segment, allowing the fractionation plug to bite into casing in the wellbore.

The fractionation plug can be used in a bridge plug configuration by placing a facial seal in the plug receiving portion of the mandrel. Threading the bridge plug device to the first plug receiving portion, and compressing the facial seal until the load shoulder bottoms out or threading the bridge plug device with an O-ring disposed thereabout to the second plug receiving portion.

The fractionation plug can be used in a caged ball configuration by placing a facial seal in the first plug receiving portion. Threading the caged ball device to the first plug receiving portion, and compressing the facial seal until the load shoulder bottoms out or threading the cage ball device with an O-ring disposed thereabout to the second plug receiving portion.

A load ring can be placed about the outer diameter of the mandrel. The first slip can be disposed adjacent to the load ring on the outer diameter of the mandrel. Then a first slip backup can be placed adjacent to the first slip on the outer diameter of the mandrel. A first lubricating spacer can be placed on the outer diameter of the mandrel adjacent the first slip backup.

A first secondary seal can be disposed adjacent to the first lubricating spacer. A primary seal can be disposed adjacent to the first secondary seal. A second secondary seal can be placed adjacent to the primary seal. A second lubricating spacer can be disposed adjacent to the second secondary seal.

A second slip backup can be placed adjacent to the second lubricating spacer. A second slip can be placed adjacent to the second slip backup. A removable nose cone can be threaded to the outer diameter of the mandrel adjacent the second slip. The nose cone can be torqued to the desired tension.

An anti-rotation ring can be placed on the outer diameter of the crown engagement portion and a pump down ring can be disposed about an outer diameter of the nose cone.

The plugs can be set by engaging a shear rod or setting tool with the inner diameter of the caged ball plug, ball drop plug, or bridge plug.

Turning now to the Figures, FIG. 1A depicts a mandrel according to one or more embodiments.

The mandrel 12*a* can be used to form a portion of the bridge fractionation plug.

The mandrel 12*a* can have a first end 102 and a second end 150. The mandrel 12*a* can have an overall length between 1 and 4 feet. The outer diameter of the mandrel 12*a* can be between 2 and 10 inches.

The mandrel 12*a* can have a crown engagement 20 formed in the first end 102.

The first end 120 can have a first diameter that is larger than a second diameter of the second end 150. For example, in one or more embodiments, the first diameter can be 0.75 inches and the second diameter can be 2.25 inches for a 3½ inch mandrel.

A mandrel shoulder 142 can be formed between the first end 102 and the second end 150. The mandrel shoulder 142 can be of varying angles, such as from about 10 degrees to about 25 degrees.

The second end 150 can have a first bridge plug receiving portion 152*a*, which can have a facial seal 156*a* and first internal threads 154*a*. The facial seal can be made from an elastomer, urethane, TEFLON™ brand polytetrafluoroethylene, or similar durable materials. The facial seal 156*a* can be one or more O-rings, E-rings, C-rings, gaskets, end face mechanical seal, or combinations thereof. The first bridge plug receiving portion 156*a* can be used when the operating pressure is less than 8,000 psi.

An anti-rotation ring groove 140 can be formed into the first end 102. The anti-rotation ring groove 140 can secure an anti-rotation ring, not shown in this Figure, about the mandrel 12*a*. The anti-rotation groove prevents the fractionation plug from becoming loose and falling off of a plug setting mechanism. The anti-rotation groove creates a tight fit between the anti-rotation seal and the fractionation plug setting sleeve. The anti-rotation ring can be made from elastomeric, TEFLON™ brand polytetrafluoroethylene, urethane, or a similar sealing material that is durable and able to handle high temperatures.

Figure 1B:
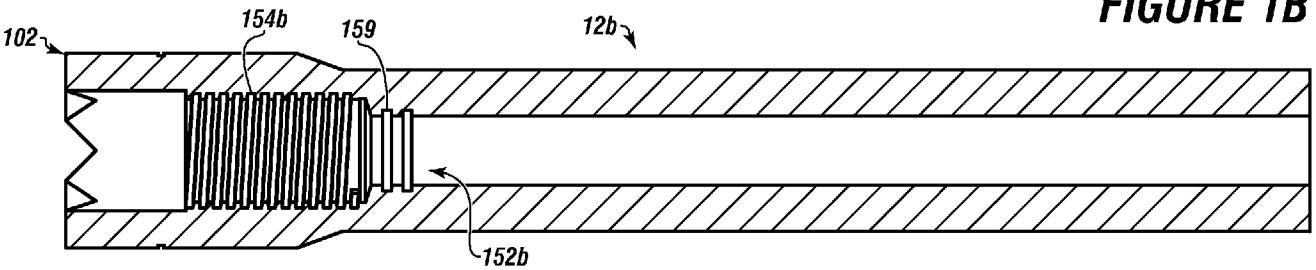
FIG. 1B depicts another embodiment of a mandrel.

FIG. 1B depicts another embodiment of a mandrel 12*b*. The mandrel 12*b* can be substantially similar to the mandrel 12*a*. The mandrel 12*b*, however, can have a second bridge plug receiving portion 152*b* formed adjacent to the first end 102. The second bridge plug receiving portion 152*b* can have one or more seals 159. The second bridge plug receiving portion 152*b* can have one or more second internal threads 154*b*. The second bridge plug receiving portion 152*b* can be used at any pressure.

Figure 1C:
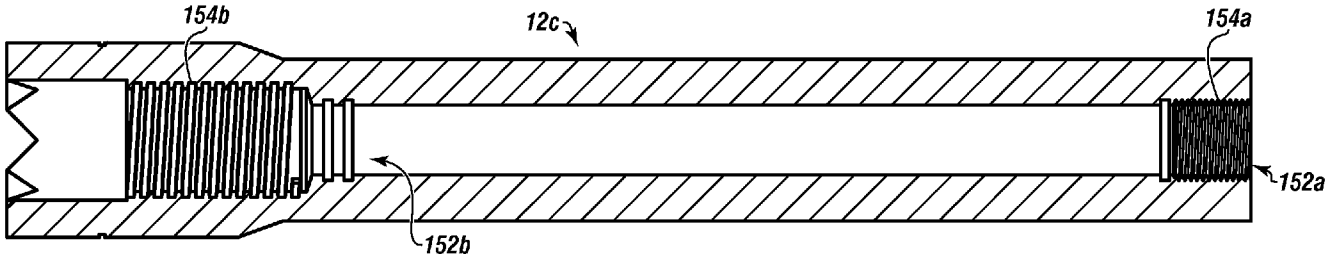
FIG. 1C depicts an additional mandrel according to one or more embodiments.

FIG. 1C depicts another embodiment of a mandrel 12*c*. The mandrel 12*c* can be substantially similar to the mandrel 12*a*, but can include the first bridge plug receiving portion 152*a* and the second bridge plug receiving portion 152*b*. The first bridge plug receiving portion 152*a* can have first internal threads 154*a*. The second bridge plug receiving portions can have second internal threads 154*b*.

Figure 2:
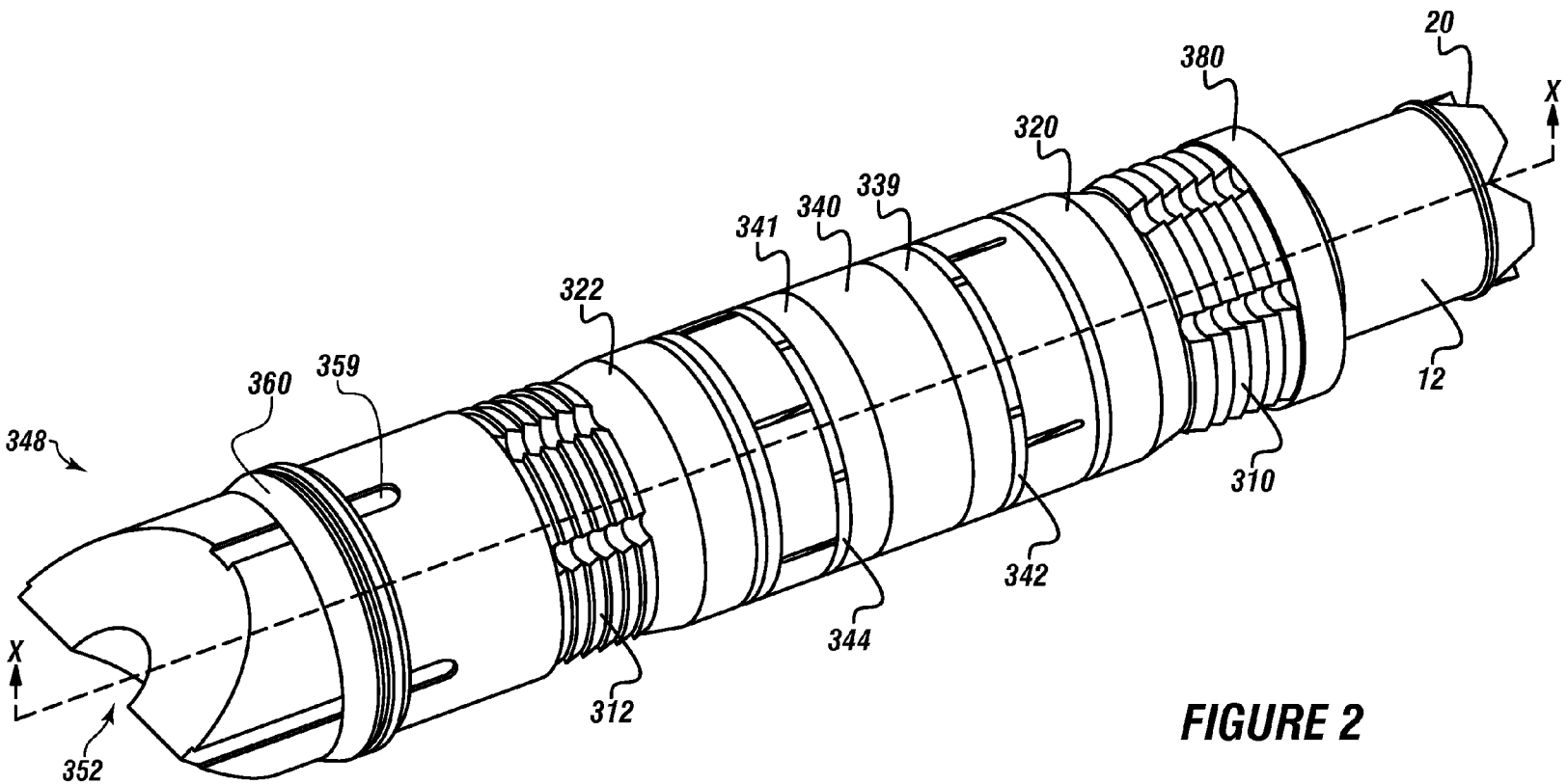
FIG. 2 is an isometric view of an illustrative fractionation plug according to one or more embodiments.

FIG. 2 is an isometric view of an illustrative fractionation plug according to one or more embodiments.

The fractionation plug can include a mandrel 12, which can be any mandrel described herein. One or more slips, such as a first slip 310 and a second slip 312 can be disposed on the mandrel 12.

The slips 310 and 312 can be made from metallic or non-metallic material. The slips 310 and 312 can have segments that bite into the inner diameter of a casing of a wellbore. The first slip 310 can be adjacent a load ring 380, and the second slip 312 can be adjacent a removable nose cone 348. The first slip 310 and the second slip 312 can be bidirectional slips, unidirectional slips, or any other slips that are used in down hole operations.

The mandrel 12 can also have one or more slip backups disposed thereon. A first slip backup 320 can be adjacent to the first slip 310. At least a portion of the first slip backup 320 can be tapered to at least partially nest within a portion of the inner diameter of the first slip 310. A second slip backup 322 can be adjacent the second slip 312. At least a portion of the second slip backup 322 can be tapered to at least partially nest within a portion of the inner diameter of the second slip 312. The slip backups can force the adjacent slip to expand into the inner diameter of the casing of the wellbore.

The slip backups can expand the first secondary seal 339, the second secondary seal 341, and the large primary seal 340. These seals can be made of any sealing material. Illustrative sealing material can include rubber, elastomeric material, composite material, or the like. These seals can be configured to withstand high temperatures, such as between 180 degrees Fahrenheit to 450 degrees Fahrenheit.

A first lubrication spacer 342 and a second lubrication spacer 344 can be disposed on the mandrel 12. The lubrication spacers can be made of a material that can allow free movement of the adjacent components such as TEFLON™ brand polytetrafluoroethylene, plastic, polyurethane. The first and second lubrication spacers are each tapered on one side and fit into the slip backups. The first and second lubrication spaces can range in length from 1 to 3 inches.

The first lubrication spacer 342 can be disposed adjacent the first slip back up 320. The first lubrication spacer 342 can be disposed between the first slip back up 320 and the first secondary seal 339.

The second lubrication spacer 344 can be disposed about the mandrel 12 adjacent the second slip backup 322. The second lubrication spacer 344 can be disposed between the large seal 340 and the second slip backup 322.

The mandrel 12 can also have a removable nose cone 348 disposed thereon. The removable nose cone 348 can have one or more pressure relief grooves 359 formed therein. The removable nose cone 348 can be of various lengths and have faces of various angles. The removable nose cone can be 6 inches long and can have first sloped face of 45 degrees and a second sloped face of 45 degrees tapering to a point together. The removable nose cone 348 can have a central annulus 352. The diameter of the central annulus can range from ⅝ of an inch to 2 inches. The removable nose cone 348 can be disposed about or connected with the mandrel 12 opposite the crown engagement 20. A pump down ring 360 can be disposed about the removable nose cone 348.

The load ring 380 can be disposed about the mandrel 12 adjacent or proximate to the crown engagement 20. The load ring 380 can reinforce a portion of the mandrel 12 to enable the mandrel 12 to withstand high pressures. The load ring 380 can be made from a composite material containing glass and epoxy resin cured material that is able to be machined, milled, cut, or combinations thereof. The load ring can be between 1 and 3 inches in length and 2 to 8 inches in diameter.

Figure 3A:
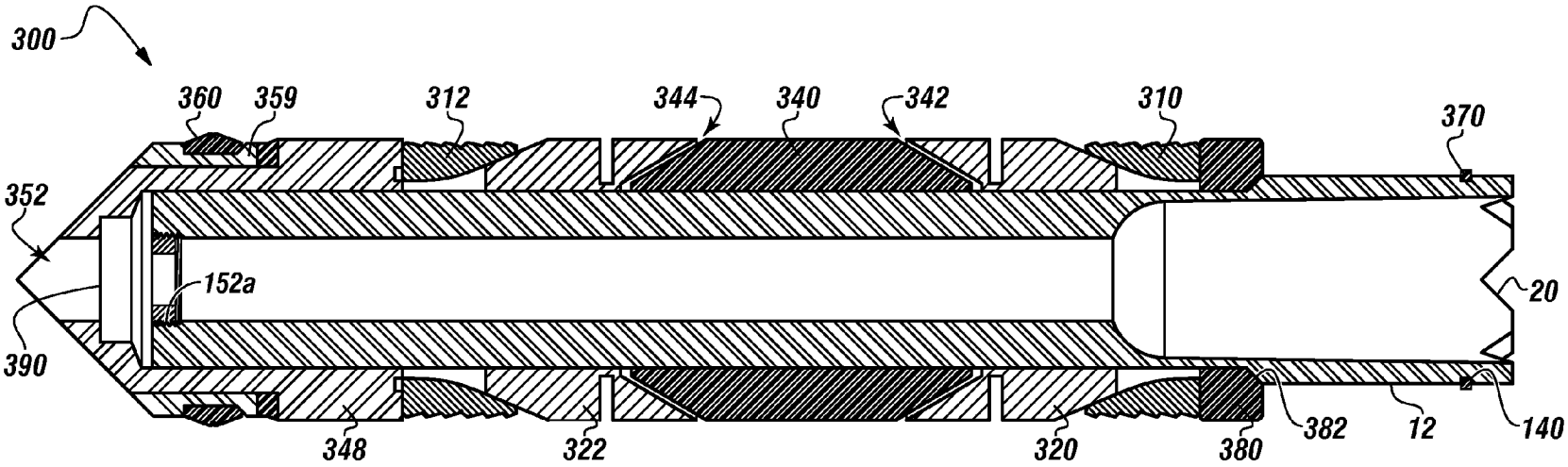
FIG. 3A is a cut view of the fractionation plug of FIG. 2 along line X-X with a bridge plug inserted therein.

FIG. 3A is a cut view of the fractionation plug of FIG. 2 along line X-X with a bridge plug inserted therein.

The fractionation plug 300 can have the mandrel 12. The mandrel 12 can have a first bridge plug receiving portion 152*a*.

A bridge plug 390 can be inserted in the first bridge plug receiving portion 152*a*. The bridge plug 390 can have a solid portion. The bridge plug can threadably connect to the first bridge plug receiving portion 152*a*. The bridge plug 390 can be any bridge plug, such as those described herein.

The removable nose cone 348 can be supported by the mandrel, the bridge plug 390, or any combination thereof.

An anti-rotation ring 370 can be secured in the anti-rotation ring groove 140.

The load ring 380 can rest on a mandrel a load ring seat 382 adjacent the load shoulder.

Also shown are pump down ring 360, the pump down ring groove 359, the first slip 310, the second slip 312, the first slip backup 320, the second slip backup 322, a large primary seal 340, the first lubrication spacer 342, the second lubrication spacer 344, and the central annulus 352.

The crown engagement 20 is also viewable in this Figure. The crown can be integral with the mandrel 12 as a one piece structure. In an embodiment, such as the 4 and ½ inch in diameter mandrel, the crown can have 6 grooves formed by 6 points that extend away from the mandrel 12, creating an engagement that securely holds another nose cone to the plug for a linear connection of two plugs in series.

Figure 3B:
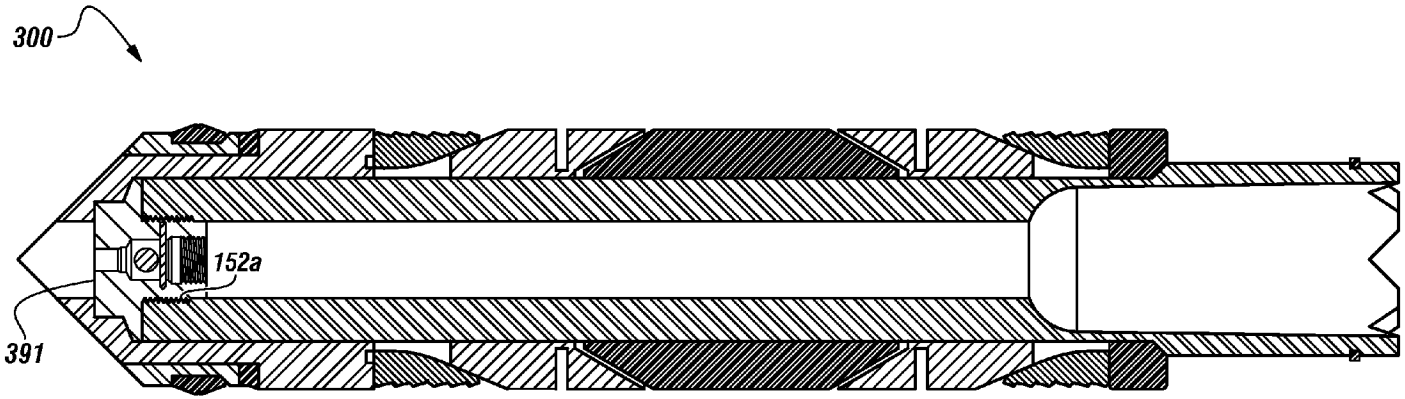
FIG. 3B is cut view of the fractionation plug along X-X with a caged ball plug inserted therein.

FIG. 3B is cut view of the fractionation plug along X-X with a caged ball plug inserted therein.

The fractionation plug 300 can have the mandrel 12 with a caged ball plug 391 inserted into the first plug receiving portion 152*a*. The caged ball plug 391 can be any caged ball plug, such as those described herein.

Figure 3C:
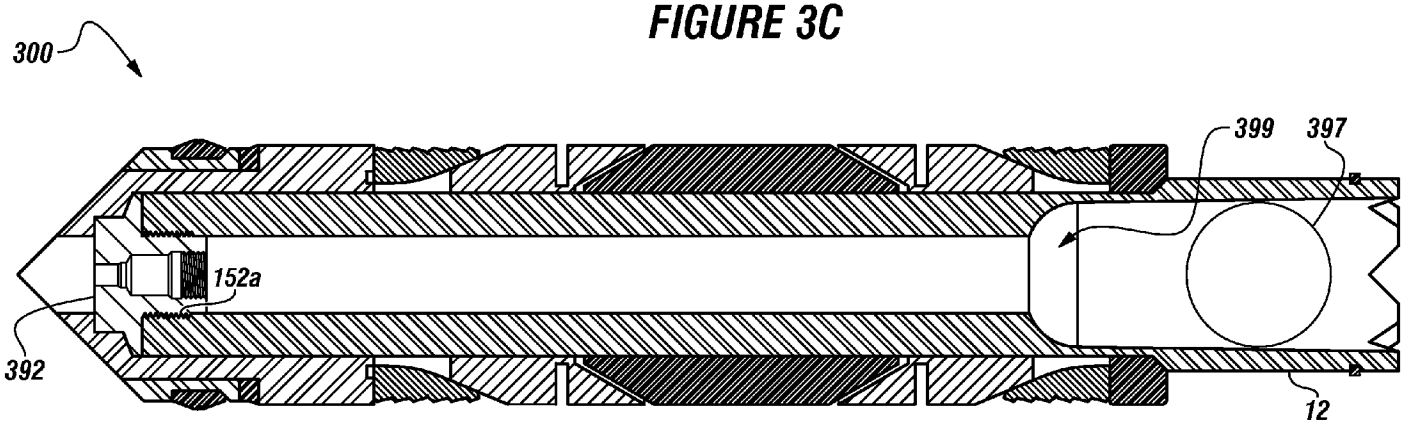
FIG. 3C is cut view of the fractionation plug along X-X with a caged ball plug inserted therein.

FIG. 3C is cut view of the fractionation plug along X-X with a ball drop plug inserted therein. The fractionation plug 300 can have the mandrel 12 with a ball drop plug 392 inserted into the first plug receiving portion 152*a*. The ball drop plug 392 can be any ball drop plug, such as those described herein.

The ball 397 can engage the ball drop plug 392, a portion of the mandrel 12, such as mandrel seat 399. For example, a ball 397 can have a diameter small enough to pass through the mandrel seat 399 and engage the ball drop plug 392. In another embodiment, the ball 397 can have a diameter large enough to engage the mandrel 399 and form at least a partial seal therewith. In one embodiment, a first ball can be engaged with the ball drop plug 392 and a second ball can be engaged with the mandrel seat 399.

Figure 4A:
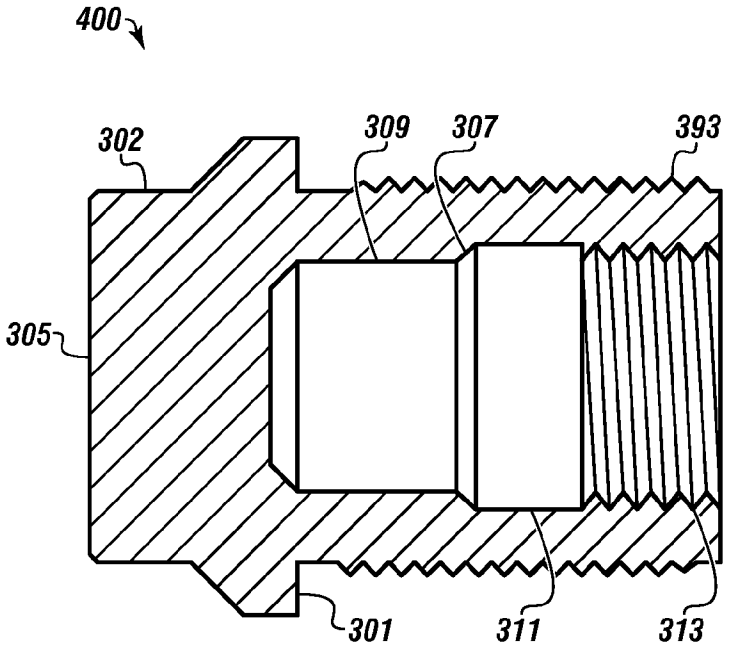
FIG. 4A depicts a schematic of a first bridge plug according to one or more embodiments.

FIG. 4A depicts a schematic of a first bridge plug 400 according to one or more embodiments.

The bridge plug can have a bridge plug extension 302. The bridge plug extension can have a solid end 305. The solid end 305 can be used to create differential pressure between zones in a wellbore.

The bridge plug 400 can have a load shoulder 301. The load shoulder 301 and the bridge plug extension 302 can support the removable nose cone.

The bridge plug 400 can have a one or more engaging threads 393 formed on an outer diameter thereof.

A first bridge plug chamber 309 can be formed in the bridge plug 400. The first bridge plug chamber 309 can have a first diameter. A second bridge plug chamber 311 can also be formed in the bridge plug. The second bridge plug chamber can have a second diameter.

The first diameter can be less than the second diameter creating a bridge plug shoulder 307 to allow the seating of a setting tool, creating a setting tool stop on the bridge plug shoulder 307. The second bridge plug chamber can have shear threads 313 to engage with the setting tool.

Figure 4B:
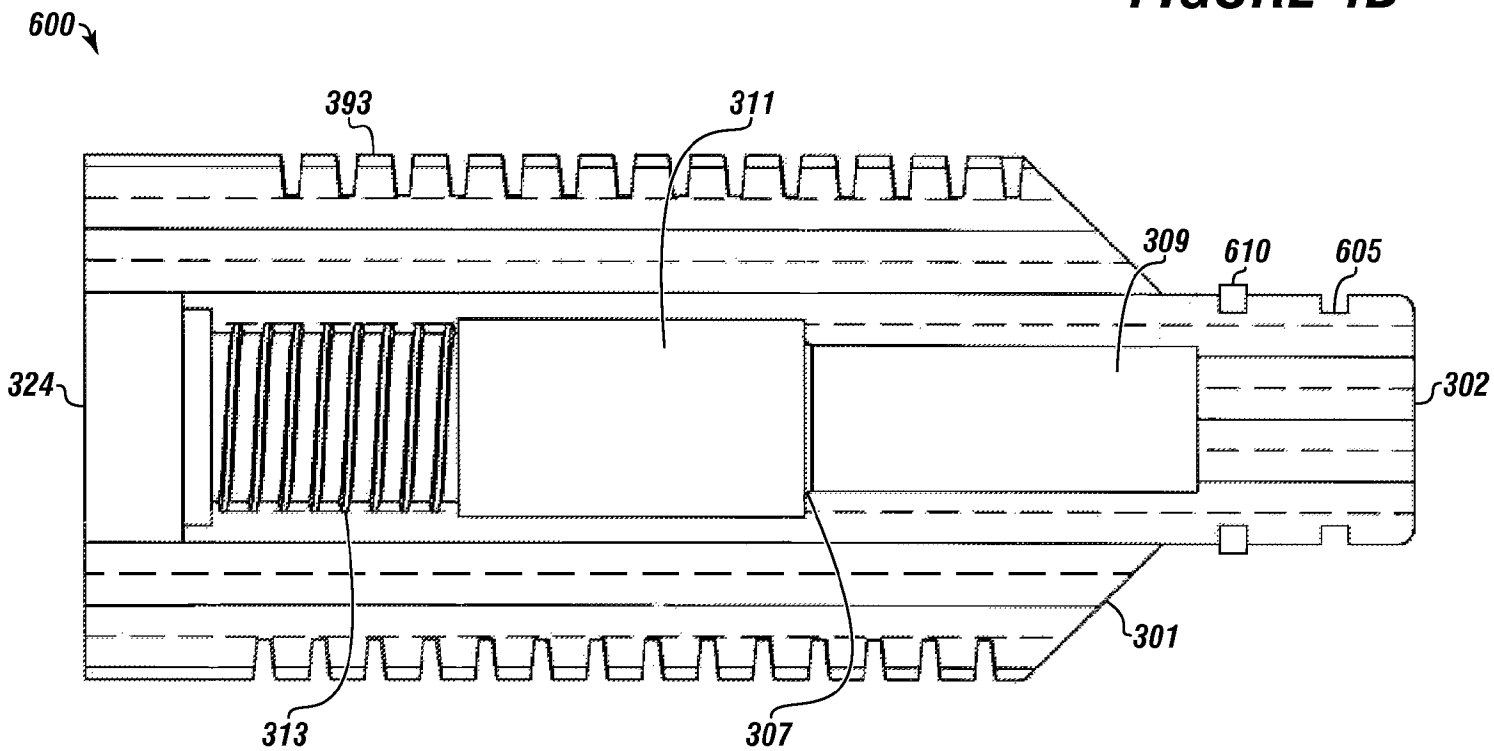
FIG. 4B depicts a schematic of a second bridge plug.

FIG. 4B depicts a schematic of a second bridge plug 600.

The bridge plug 600 can include a bridge plug extension 302. The bridge plug extension 302 can have one or more seal grooves 605. The seal grooves 605 can support one or more seals 610.

The bridge plug 600 can have the first chamber 309 and the second chamber 311 formed therein. The bridge plug 600 can have one or more shear threads 313 formed on an inner diameter of the second chamber 311.

The bridge plug 600 can include a load shoulder 301. The bridge plug 600 can also have one or more engaging threads 393 formed on an outer diameter thereof.

The bridge plug 600 can also include a tightening groove 324. The bridge plug 600 can be engaged with the second bridge plug receiving portion.

The bridge plug 600 can include the bridge plug shoulder 307 that acts like a setting tool stop on the bridge.

Figure 4C:
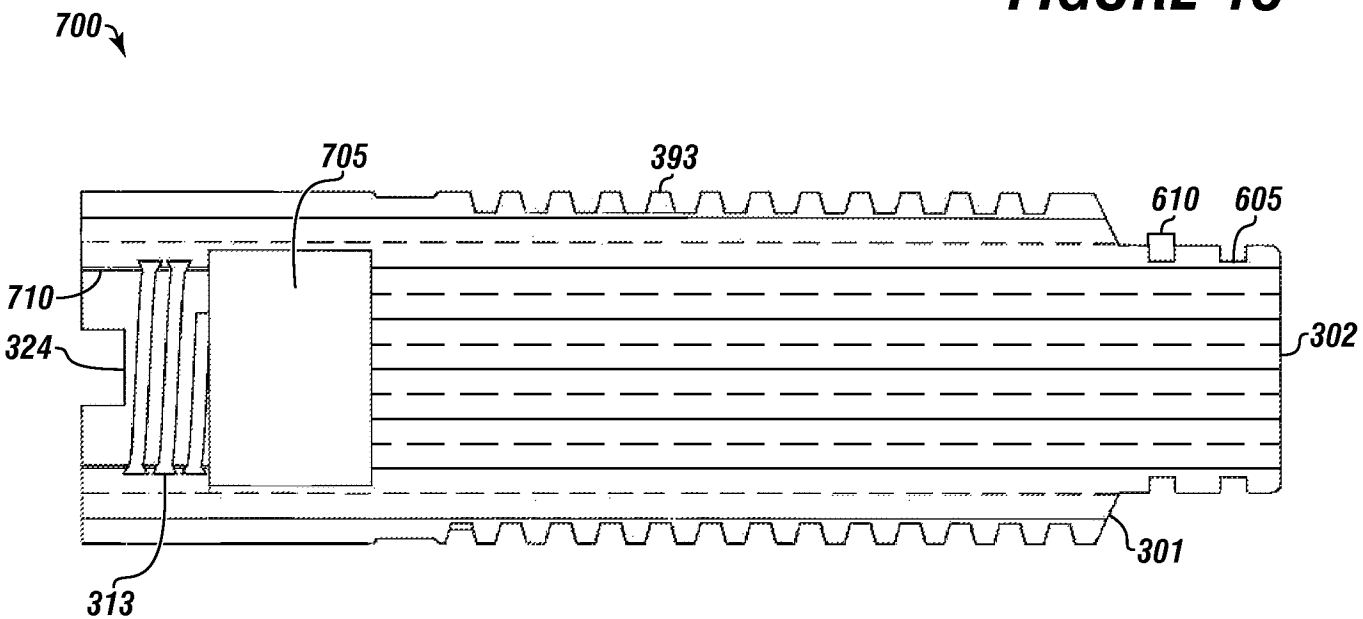
FIG. 4C depicts a schematic of a third bridge plug.

FIG. 4C depicts a schematic of a third bridge plug 700.

The third bridge plug 700 a bridge plug extension 302. The bridge plug extension 302 can have one or more seal grooves 605. The seal grooves 605 can support one or more seals 610.

The bridge plug 600 can include a load shoulder 301. The bridge plug 600 can also have one or more engaging threads 393 formed on an outer diameter thereof. The bridge plug 600 can also include a tightening groove 324.

The bridge plug 600 can include a threaded chamber 710 that can have one or more shear threads 313 formed on an inner diameter thereof. The bridge plug 600 can include an additional chamber 705.

Figure 5A:
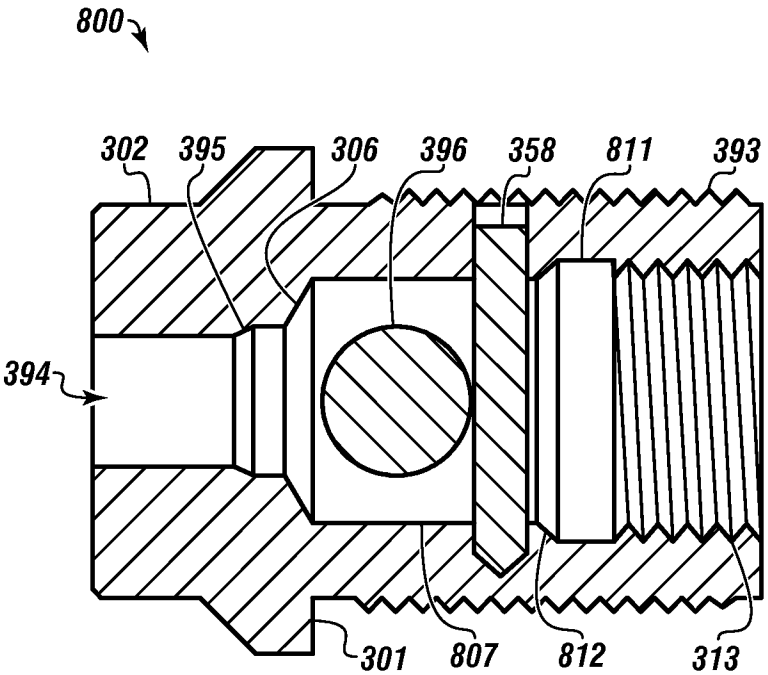
FIG. 5A depicts a schematic of a first caged ball plug according to one or more embodiments.

FIG. 5A depicts a schematic of a first caged ball plug 800 according to one or more embodiments.

The first caged ball plug 800 can include an extension 302 with an extension portal 394, a caged ball retaining rod 358 and a caged ball 396. The extension portal 394 can be used to allow for differential pressure between zones in a wellbore.

The first caged ball plug 800 can also include the load shoulder 301 and the engaging threads 393.

The first caged ball plug 800 can have a caged ball chamber 807 with a first diameter. The caged ball retaining rod 358 can be secured adjacent to the caged ball chamber 807. The caged ball retaining rod 358 can keep the caged ball 396 within the caged ball chamber 807.

An upper chamber 811 can be formed into the first caged ball plug 800. The caged ball chamber 807 can have a smaller diameter than the upper chamber 811.

A setting tool stop 812 can be formed between the caged ball retaining rod 358 and the upper chamber 811.

The upper chamber 811 can have shear threads 313 to engage with the setting rod.

The caged ball 396 can be guided by a caged ball seat guide 306 into the caged ball seat 395 when fluid pressure is applied.

Figure 5B:
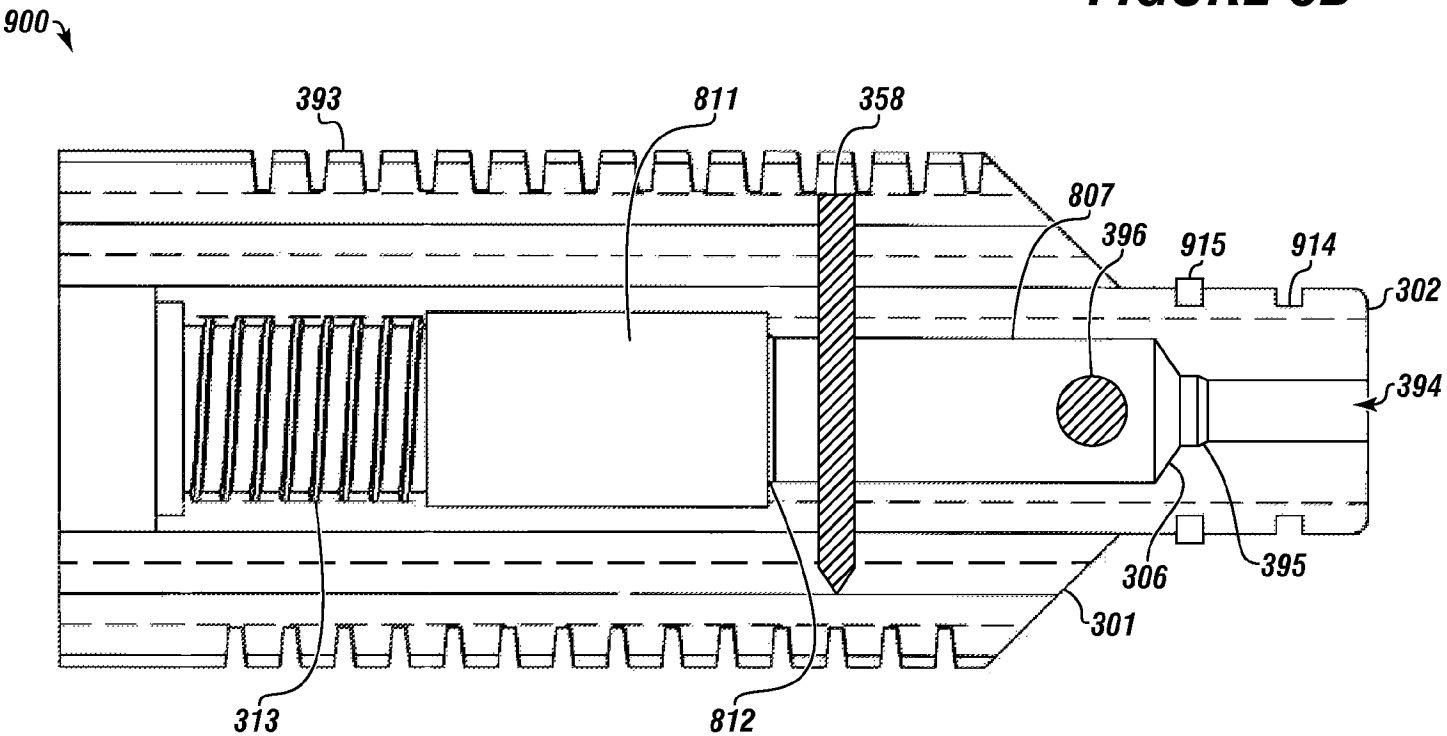
FIG. 5B depicts a schematic of a second caged ball plug according to one or more embodiments.

FIG. 5B depicts a schematic of a second caged ball plug 900 according to one or more embodiments.

The second caged ball plug 900 can include the extension 302 with an extension portal 394, a caged ball retaining rod 358, and a caged ball 396. The extension portal 394 can be used to allow for differential pressure between zones in a wellbore.

The second caged ball plug 900 can also include the load shoulder 301 and the engaging threads 393.

The second caged ball plug 900 can have a caged ball chamber 807 with a first diameter. A caged ball retaining rod 358 can be secured adjacent to the caged ball chamber 807. The caged ball retaining rod 358 can keep the caged ball 396 within the caged ball chamber 807.

An upper chamber 811 can be formed into the second caged ball plug 900. The caged ball chamber 307 can have a smaller diameter than the upper chamber 811.

A setting tool stop 812 can be formed between the caged ball retaining rod 358 and the upper chamber 811.

The upper chamber 811 can have shear threads 313 to engage with the setting rod.

The caged ball 396 can be guided by a caged ball seat guide 306 into the caged ball seat 395 when fluid pressure is applied.

The extension 302 can include one or more seal grooves 914. Each seal groove can have a seal 915 secured therein. The seals can be O-rings or the like.

Figure 5C:
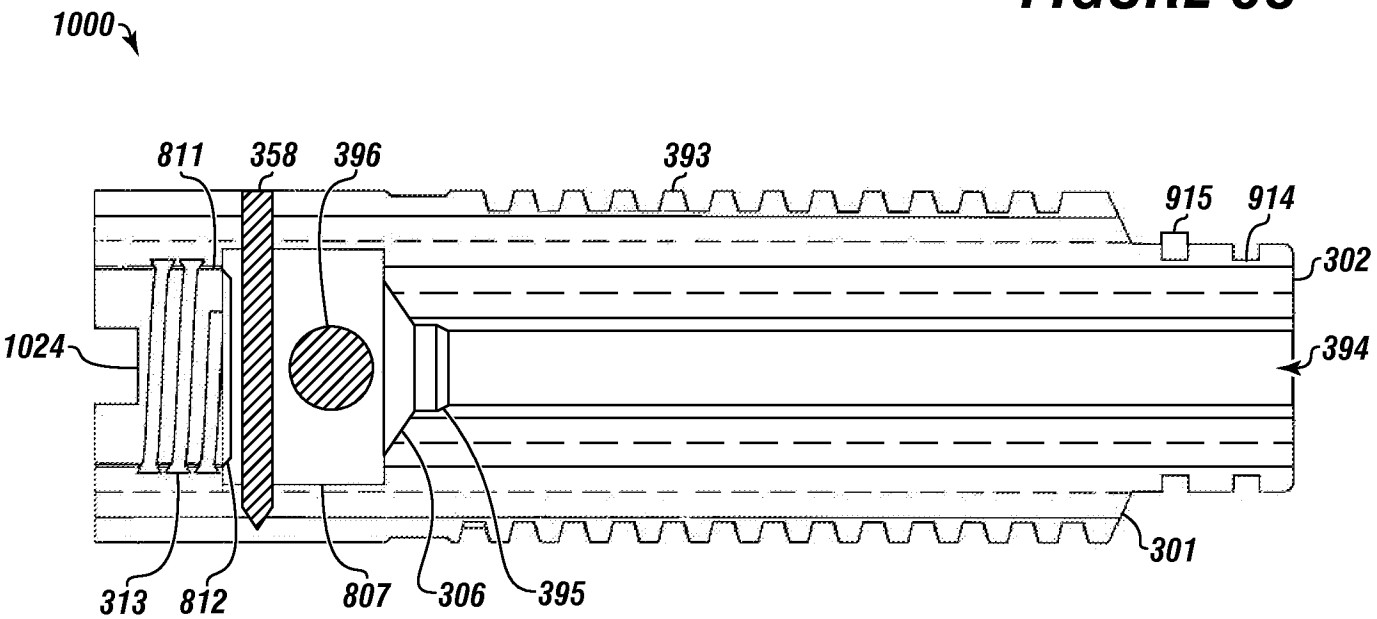
FIG. 5C depicts a schematic of a third caged ball plug according to one or more embodiments.

FIG. 5C depicts a schematic of a third caged ball plug 1000 according to one or more embodiments.

The third caged ball plug 1000 can include the extension 302 with an extension portal 394, a caged ball retaining rod 358 and a caged ball 396. The extension portal 394 can be used to allow for differential pressure between zones in a wellbore.

The third caged ball plug 1000 can also include the load shoulder 301 and the engaging threads 393.

The third caged ball plug 1000 can have a caged ball chamber 807 with a first diameter. The caged ball retaining rod 358 can be secured adjacent to the caged ball chamber 807. The caged ball retaining rod 358 can keep the caged ball 396 within the caged ball chamber 807.

An upper chamber 811 can be formed into the third caged ball plug 1000.

A setting tool stop 812 can be formed between the caged ball retaining rod 358 and the upper chamber 811.

The upper chamber 811 can have shear threads 313 formed therein.

The caged ball 396 can be guided by a caged ball seat guide 306 into the caged ball seat 395 when fluid pressure is applied.

The extension 302 can include one or more seal grooves 914. Each seal groove can have a seal 915 secured therein. The seals can be O-rings or the like.

The third caged ball plug 1000 can have a tightening groove 1024.

Figure 6:
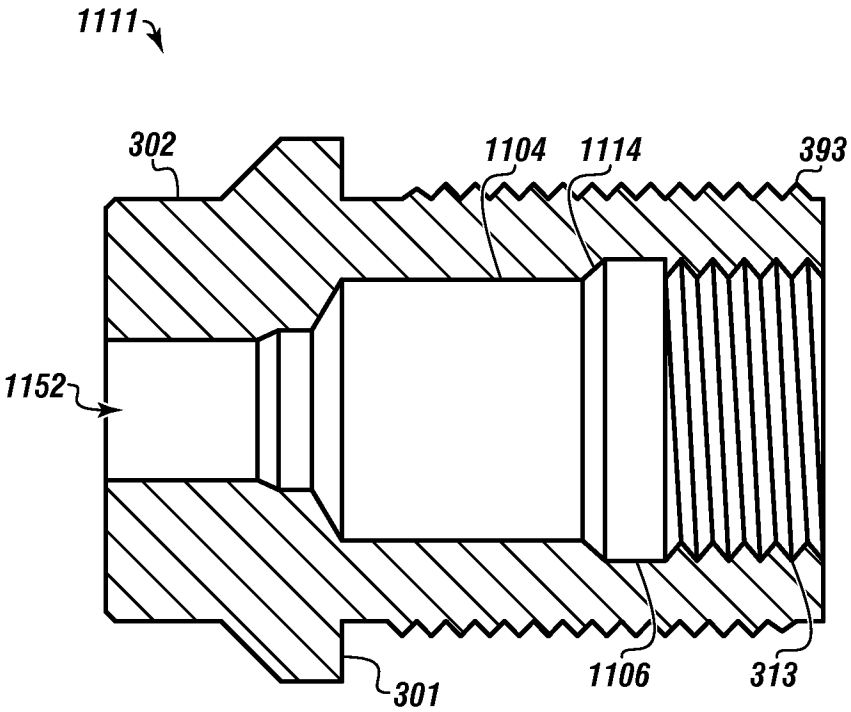
FIG. 6 depicts a schematic of a ball drop plug.

FIG. 6 depicts a schematic of a ball drop plug 1111.

The ball drop plug 1111 can have an annulus 1152, the load shoulder 301, and the extension 302.

A first chamber 1104 can be formed in the ball drop plug 1111 adjacent the annulus 1152. A second chamber 1106 can be adjacent the first chamber 1104. A setting tool stop 1114 can be formed between the chambers 1104 and 1106.

The ball drop plug 1111 can also include shear threads 313.

Figure 7:
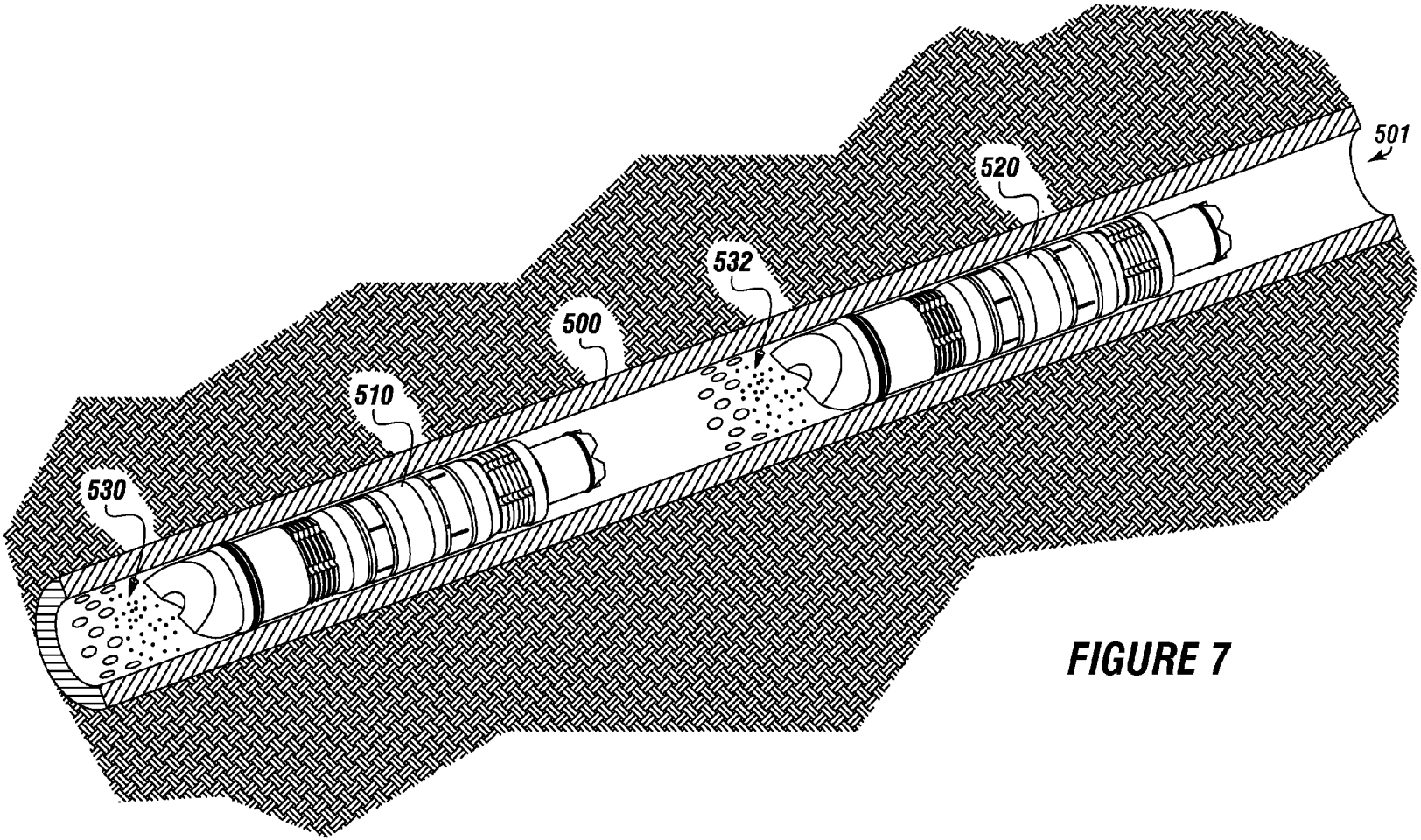
FIG. 7 is a schematic of two fractionation plugs disposed within a wellbore.

FIG. 7 is a schematic of two fractionation plugs disposed within a wellbore.

As depicted, the wellbore 501 can have a perforated casing 500 and two hydrocarbon bearing zones 530 and 532.

The ball drop plug 1111 can have a one or more engaging threads 393.

The embodiments of the fractionation plug described herein can be used within casing or within production tubing. For example, in one or more embodiments, the fractionation plug can be used within the wellbore casing.

In operation, coil tubing, wire lines, or other devices, which are not shown, can be used to place the fractionation plugs 510 and 520 into the wellbore 501. The fractionation plugs 510 and 520 can isolate the hydrocarbon bearing zones 530 and 532 from one another.

Once the plug is at a designated location, the setting tool can pull the mandrel, holding the outer components on the mandrel, which can compress the outer components, the slips and slip backups for engagement with the casing of the wellbore.

Once the plug is set in place, the casing in the wellbore can be perforated, such as with a well perforating gun.

If the fractions plugs 510 and 520 are in a caged ball configuration, fractionation can be initiated by pumping water, sand, and chemical through the wellbore into the plug forcing the caged ball to seat on the caged ball seat sealing off the lower fractionation zone from an upper fractionations zone. The plug can be left in place until the fractionation stage is completed.

If the fractions plugs 510 and 520 are in a drop ball configuration, fractionation can be initiated by pumping a first ball having a first size into the lower fraction action plug 510 seating the ball in the ball seat. The hydrocarbon bearing zone adjacent the lower fractionation plug 510 can be fractured.

A second ball having a second size can be pumped into the upper fractionation plug 520, and the second ball can sit on the ball seat of the upper fractionation plug 520. The hydrocarbon bearing zone adjacent the upper fraction plug 520 can be fractured.

If the fractionation plugs 510 and 520 are used the fractionation process can be carried out in a manner known to one skilled in the art.

While these embodiments have been described with emphasis on the embodiments, it should be understood that within the scope of the appended claims, the embodiments might be practiced other than as specifically described herein.

What is claimed is:

1. A fractionation plug for use in separating an upper zone from a lower zone in a wellbore having a ball drop configuration, a bridge plug configuration, and a caged ball configuration using one mandrel, wherein the modular changeable fractionation plug comprises:

a. a mandrel having a crown engagement and a first plug receiving portion and a second plug receiving portion, wherein the crown engagement has a larger diameter portion with a diameter larger than the plug receiving portions, and wherein the receiving portions or between the terminal ends of the mandrel, and wherein an anti-rotation ring is disposed on the larger diameter portion of the crown engagement;

b. a load ring disposed about the mandrel;

c. a first slip disposed adjacent to the load ring;

d. a first slip backup adjacent the first slip onto the mandrel;

e. a first lubricating spacer adjacent the first slip backup;

f. a first secondary seal adjacent the first lubricating spacer;

g. a primary seal adjacent the first secondary seal;

h. a second secondary seal adjacent the primary seal;

i. a second lubricating spacer adjacent the second secondary seal;

j. a second slip backup adjacent the second lubricating spacer;

k. a second slip adjacent the second slip backup;

l. a removable nose cone disposed over the mandrel adjacent the second slip, wherein the removable nose cone comprises:

(i) a nose cone body with an opening;

(ii) a dual tapered engagement integral with the nose cone body, wherein the tapered engagement comprises a first sloped face, and a second sloped face;

(iii) a central annulus formed between the first sloped face and the second sloped face;

(iv) a pump down ring groove formed between the nose cone body and the tapered engagement for containing a pump down ring;

(v) a plurality of pressure relief grooves extending longitudinally, with each pressure relief groove disposed on an outer surface of the nose cone body; and (vi) a facial seal formed in the plug receiving end of the mandrel;

m. wherein the mandrel is adapted to use a bridge plug configuration comprising:

(i) a first bridge plug threadable into the plug receiving portion, wherein the bridge plug device comprises:

(a) a bridge plug body engaging the facial seal;

(b) a solid end on a first end of the bridge plug body;

(c) a load shoulder formed between the bridge plug body and the solid end;

(d) an extension extending from the load shoulder opposite the solid end; and (e) engaging threads extending over an outer surface of the bridge plug body engaging the internal threads of the plug receiving end, wherein the bridge plug body further comprises:

(i) a first shear device chamber having a first diameter;

(ii) a second shear device chamber having a second diameter, wherein the second diameter is larger than the first diameter creating a shear device shoulder; and (iii) shear threads formed around the second shear device chamber;

(ii) a second bridge plug threadable into the second plug receiving portion, wherein the second bridge plug device comprises:

(a) a bridge plug body engaging the inner diameter of the mandrel;

(b) a solid end on a first end of the bridge plug body;

(c) a load shoulder formed between the bridge plug body and the solid end;

(d) an extension extending from the load shoulder opposite the solid end; and (e) engaging threads extending over an outer surface of the bridge plug body engaging the internal threads of the plug receiving end, wherein the bridge plug body further comprises:

(i) a first bridge plug chamber having a first diameter;

(ii) a second bridge plug chamber having a second diameter, wherein the second diameter is larger than the first diameter creating a shear device shoulder; and (iii) shear threads formed on an inner diameter of the second shear device chamber;

n. wherein the mandrel is adapted to use a caged ball configuration comprising:

(i) a caged ball plug threadable into the plug receiving end between the facial seal and the removable nose cone, wherein caged ball plug comprises:

(a) a caged ball plug body engaging the facial seal;

(b) a load shoulder adjacent the caged ball plug body;

(c) an extension extending from the load shoulder opposite the facial seal; and (d) engaging threads extending on an outer surface of the caged ball plug body engaging internal threads of the plug receiving end, wherein the caged ball plug body further comprises:

(i) an internal caged ball seat formed within the caged ball device;

(ii) a caged ball seat guide adjacent the internal caged ball seat;

(iii) a first caged ball chamber adjacent the caged ball seat guide having a first diameter for supporting a caged ball;

(iv) a caged ball retaining rod adjacent the first shear device chamber;

(v) a second caged ball chamber within the caged ball device having a second diameter; and (vi) shear threads formed on an inner diameter of the second caged ball chamber;

o. wherein the mandrel is adapted to use a ball drop configuration comprising:

(i) a ball drop plug threadable into the mandrel receiving end between the facial seal and the removable nose cone, and further wherein ball drop plug comprises:

(a) a ball drop body engaging the facial seal;

(b) the load shoulder adjacent the ball drop body;

(c) the extension extending from the load shoulder;

(d) a ball drop plug annulus centrally formed in the ball drop body and extending longitudinally through the body for allowing pressure to flow through the ball drop plug annulus until a fractionation ball seats in a seating area of the crown engagement while simultaneously allowing fluid to flow from a lower fractionation zone to an upper fractionation zone;

(e) engaging threads extending over an outer surface of the ball drop plug body engaging internal threads of the plug receiving end;

(f) a first shear device chamber having a first diameter;

(g) a second shear device chamber having a second diameter, wherein the second diameter is larger than the first diameter creating a shear device shoulder for receiving a setting tool; and (h) shear threads formed on an inner diameter of the second shear device chamber; and p. further wherein the bridge plug configuration, ball drop configuration, and caged ball configuration with the fractionation plug components, form a modular changeable fractionation plug for use in separating the upper fractionation zone from the lower fractionation zone in a wellbore.

2. The modular changeable fractionation plug of claim 1, wherein in the bridge plug configuration, the bridge plug comprises left handed threads.

3. The modular changeable fractionation plug of claim 1, wherein the mandrel is a 100 percent composite material of epoxy coated glass fibers.

4. The modular changeable fractionation plug of claim 1, wherein the slips are metallic, non-metallic, or combinations thereof.

5. The modular changeable fractionation plug of claim 1, wherein the large primary seal comprises three segments.

6. The modular changeable fractionation plug of claim 1, wherein in the caged ball configuration, the fractionation ball retaining rod is metallic or non-metallic.

7. The modular changeable fractionation plug of claim 1, wherein in the caged ball configuration the fractionation ball retaining rod extends across the central annulus.

8. The modular changeable fractionation plug of claim 1, wherein in the caged ball configuration, the fractionation ball retaining rod has a threaded engagement for engagement with a setting tool.

9. The modular changeable fractionation plug of claim 1, wherein in the caged ball configuration the shear device comprises left handed threads.

10. The modular changeable fractionation plug of claim 1, wherein each slip back-up contains from 4 longitudinal slots to 10 longitudinal slots extending partially through the slip backup.

11. The modular changeable fractionation plug of claim 1, wherein each slip comprises radial relief grooves formed in the slips.

12. The modular changeable fractionation plug of claim 1, wherein each slip has a tapered engagement.

13. The modular changeable fractionation plug of claim 12, further comprising 4 pressure relief grooves to 10 pressure relief grooves formed in each slip, with at least one pressure relief groove disposed on opposite sides of the tapered engagement.

14. The modular changeable fractionation plug of claim 12, wherein the first slip and second slip are comprised of teeth segments, with disposed along the length of each slip.

15. The modular changeable fractionation plug of claim 14, wherein from 5 teeth to 20 teeth are formed on each teeth segment allowing the fractionation plug to bite into casing in the wellbore.

* * * * *